US005179895A

United States Patent [19]

Bauer

[11] Patent Number: 5,179,895

[45] Date of Patent: Jan. 19, 1993

[54] TRASH COMPACTOR

[76] Inventor: John R. Bauer, 6741 S. Birmingham, Tulsa, Okla. 74136

[21] Appl. No.: 694,383

[22] Filed: May 1, 1991

[51] Int. Cl.[5] ..... B30B 1/18

[52] U.S. Cl. ..... 100/193; 100/229 A; 100/237; 100/290; 474/134

[58] Field of Search ..... 100/290, 100, 221, 224, 100/225, 229 A, 237, 289, 193; 474/111, 134

[56] References Cited

U.S. PATENT DOCUMENTS

| | | | |
|---|---|---|---|
| 431,444 | 7/1890 | Cross | 100/229 R |
| 1,327,815 | 1/1920 | Francis | 100/193 |
| 2,221,241 | 11/1940 | Mallory | 100/193 |
| 2,352,797 | 7/1944 | Miller | 474/134 |
| 3,438,321 | 4/1969 | Gladwin | 100/221 |
| 3,695,175 | 10/1972 | Bausenbach et al. | 100/193 |
| 3,717,091 | 2/1973 | Moon | 100/53 |
| 3,726,211 | 4/1973 | Gladwin | 100/221 |
| 3,728,977 | 4/1973 | Brannan | 100/8 |
| 3,731,618 | 5/1973 | Leman | 100/229 |
| 3,734,006 | 5/1973 | Hennells | 100/193 |
| 3,768,398 | 10/1973 | Ullman, Jr. | 100/246 |
| 3,772,987 | 11/1973 | Difley | 100/229 A |
| 3,862,593 | 1/1975 | Engebretsen | 100/229 A |
| 3,878,774 | 4/1975 | Frossard | 100/193 |
| 3,995,543 | 12/1976 | Montalbano | 100/229 A |
| 4,011,810 | 3/1977 | Santic | 100/290 |
| 4,036,152 | 7/1977 | Bright | 100/8 |
| 4,054,088 | 10/1977 | Nee | 100/229 A |
| 4,084,497 | 4/1978 | Khan | 100/229 A |
| 4,113,125 | 9/1978 | Schiller | 220/909 |
| 4,188,877 | 2/1980 | Khan | 100/229 A |
| 4,372,726 | 2/1983 | Lutz | 100/193 |
| 4,557,658 | 12/1985 | Lutz | 100/193 |
| 4,565,125 | 1/1986 | Khan | 100/229 A |
| 4,641,574 | 2/1987 | Chesnut | 100/290 |
| 4,719,852 | 1/1988 | Durbin | 100/229 A |
| 4,974,746 | 12/1990 | Dickinson | 220/404 |
| 4,993,993 | 2/1991 | Gill | 474/111 |
| 5,062,358 | 11/1991 | Fox | 100/229 A |

FOREIGN PATENT DOCUMENTS

| | | | |
|---|---|---|---|
| 2123435 | 12/1972 | Fed. Rep. of Germany | 100/229 A |
| 2740455 | 3/1979 | Fed. Rep. of Germany | 474/134 |

*Primary Examiner*—Philip R. Coe
*Assistant Examiner*—Randall Edward Chin
*Attorney, Agent, or Firm*—Head & Johnson

[57] ABSTRACT

A residential trash compactor with two compartments suitable for separating recyclable from non-recyclable trash.

1 Claim, 4 Drawing Sheets

TRASH COMPACTOR

BACKGROUND OF THE INVENTION

1. Field of the Invention

This invention relates generally to the field of trash compacting and more specifically to trash compactors which will allow separation of recyclable from non-recyclable trash in residential trash compactors.

2. Description of the Related Art

There are numerous commercial residential trash compactors on the market today. These are usually either free-standing or built-in types. They generally consist of a frame or housing, a drawer in the housing, with a compaction compartment therein, that can be slid out to receive trash and slid in to conceal and compact the trash. Compaction is usually achieved by a ram that is driven by one or more screws. The motive force is usually an electric motor, although as disclosed above in Leman, '618, a manual screw may be used. As noted in Moon, U.S. Pat. No. 3,717,091, the compacting means may also be a screw jack. The drawer has a single compartment. A removable bag or lining is placed in the compartment prior to inserting trash and compaction. After compacting, the bag/liner may be removed with the compacted trash and a new bag or liner placed in the compartment.

The problem with current commercial residential trash compactors is that all types of trash go into the same compartment for compaction—they offer no way to separate recyclable from non-recyclable trash. As people become more conscious of environmental needs, the desire to recycle becomes more intense. Yet the current commercial residential trash compactor has not been adapted to meet this need.

SUMMARY OF THE INVENTION

It is an object of this invention to provide a residential trash compactor that will allow separation of recyclable from non-recyclable trash.

It is a further object of this invention to do this in a way that will conform with existing commercial residential trash compactors in size, shape and operation.

Basically, this comprises three modifications of existing commercial models. The description below pertains to models of the WHIRLPOOL® line of trash compactors (TU4000, TF4500, TU8000 and TF8500 series), but can easily be applied to other commercially available brands and series of trash compactors. For example, some GE® (General Electric) compactors use a circular container and compacting means, this invention can be adapted to any such shape.

First, the single large trash receiving compartment in the drawer of the compactor is divided into two separate compartments. These may be equal or unequal in size. More than two compartments may be made, but the preferred embodiment uses two. The two smaller compartments may be made by placing a divider in the single large compartment, by making two new separate containers, or by placing suitably sized permanent or replaceable inserts into the single large compartment.

Second, the compacting ram of the single compartment compactor is replaced by two separate rams, to fit individually into the two smaller compartments. This requires the addition of additional power screws to drive the rams. A screw jack or other types of commercially available compaction means may also be used.

Third, three idler sprockets are positioned so as to reroute the drive chain to achieve the proper meshing of chain and power screw sprockets. Two of the idler sprockets are stationary (one on each side) and are mounted on fixed brackets. The third idler sprocket (on the front) is mounted on a slotted bracket so it can be adjusted to provide proper chain tension.

There is thus produced a trash compactor suitable for residential use having a housing, a drawer slidably disposed in the housing, at least two compartments within the drawer, a compacting ram for each compartment, and means for driving each ram to compact trash within each of the plurality of compartments.

Various adaptations of the above may be made. There may be a single compacting control that starts the drive in both rams, or there may individual controls. Both rams may deliver the same pressure, or the gear ratios may be changed on the drive chain to cause one ram to deliver a higher compaction force.

DESCRIPTION OF THE PREFERRED EMBODIMENT

Various types of commercial compactors may be modified by my invention, such as WHIRLPOOL®, GE®, KENMORE® or the like. The preferred embodiment described here uses the WHIRLPOOL® line. The publication cited above (Whirlpool, Do-It-Yourself Repair Manual for Your Whirlpool Trash Masher® Compactor) discloses parts, structure and function, of the unmodified compactor in detail, and the reader who is unfamiliar with compactors is referred to this publication to supplement the disclosure below.

Figure 1:
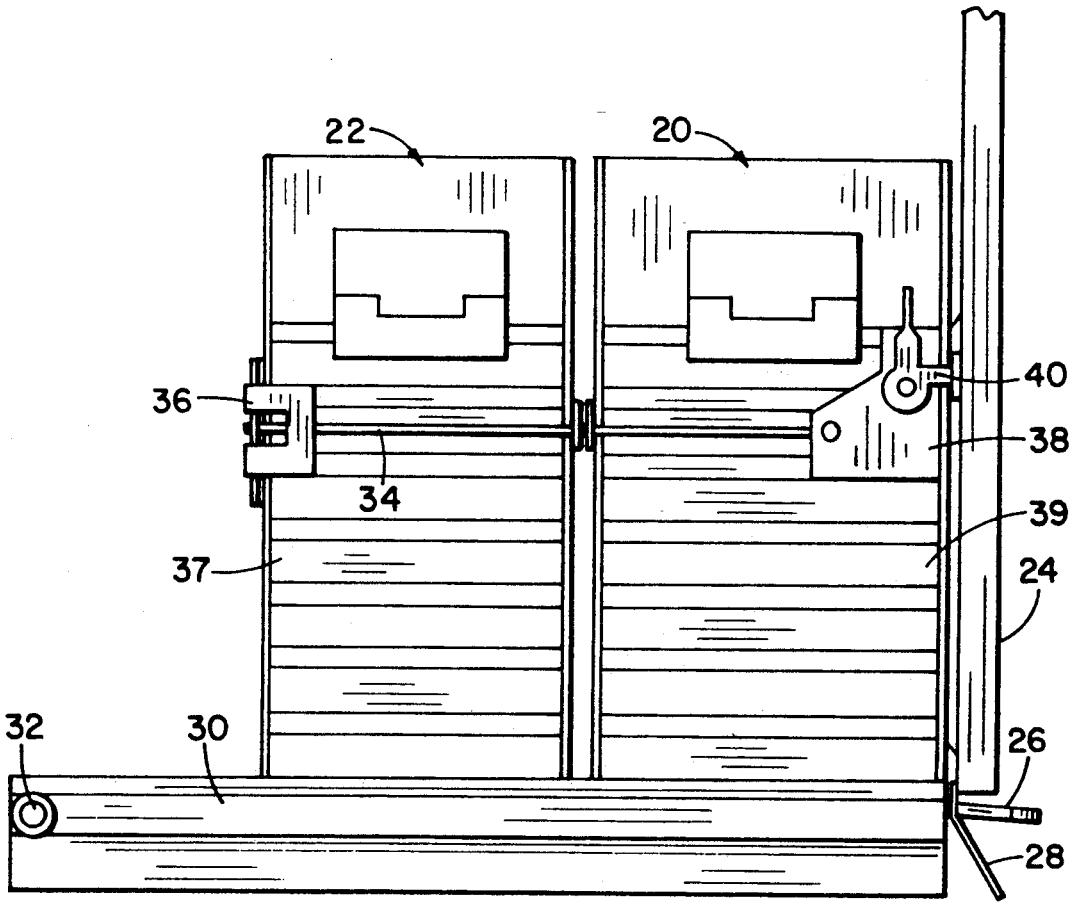
FIG. 1 is an elevational side view of the compactor drawer.

FIG. 1 is an elevational side view of the compactor drawer. This demonstrates a front compartment 20 and a rear compartment 22 suitable for receiving different types of trash. Also shown is the drawer front 24 with a foot pedal 26 for opening the drawer 24 and a toe guard 28 for protecting the base of the drawer. The two compartments 20 and 22 are mounted on a drawer guide 30 which has drawer rollers 32 thereon. The two compartments 20 and 22 are further held together by a latch rod 34 attached at one end to the back of the rear compartment 22 to a rear latch guide 36 and at the forward end attached to a latch plate 38. The latch rod 34 extends along the sides 37 and 39 of the compartments. The sides of the compartments are hinged at the bottom (not shown) to facilitate removal of compacted trash. Also attached to the latch plate 38 is a drawer latch mechanism 40 for securing the drawer in the closed position, this latch mechanism 40 may be on either the right or left side of the compartment. Various sizes and shapes of compactor compartments may be used, such as round, square, rectangular, and the like.

Figure 2:
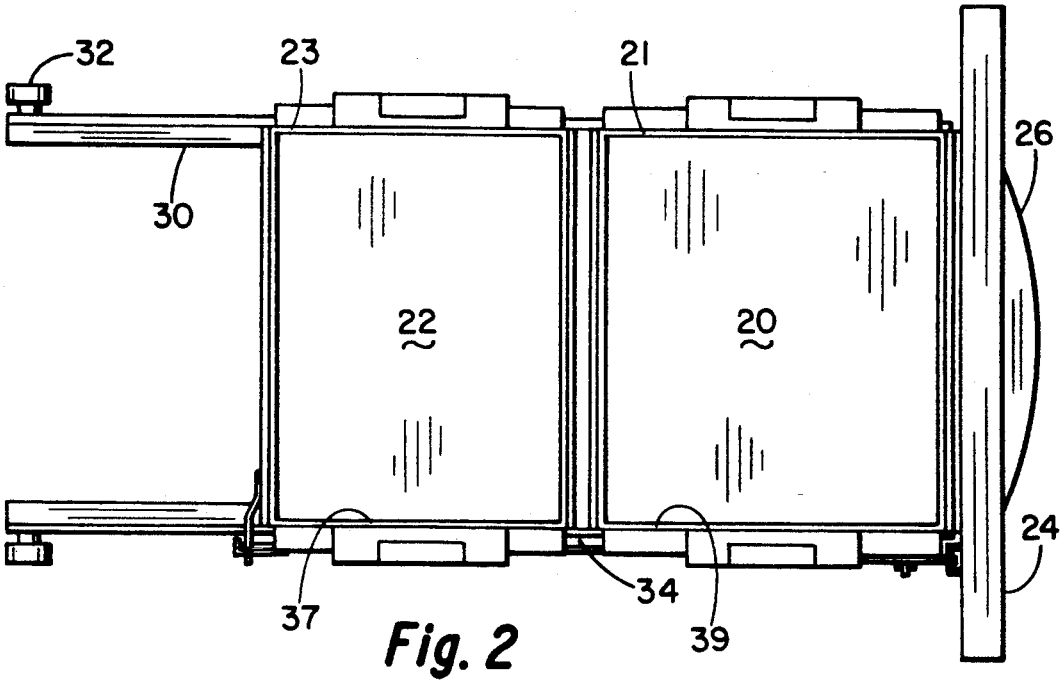
FIG. 2 is a top plan view of the compactor drawer.

FIG. 2 is a top view of the compactor drawer showing the two compartments; front 20 and rear 22. These compartments may be equal in size or unequal. In a preferred embodiment, these compartments are open only at the top. More than two compartments may be used. The sides of the compartments 21, 23, 37, and 39 are hinged at their base (not shown) to allow the easy removal of compacted trash.

Figure 3:
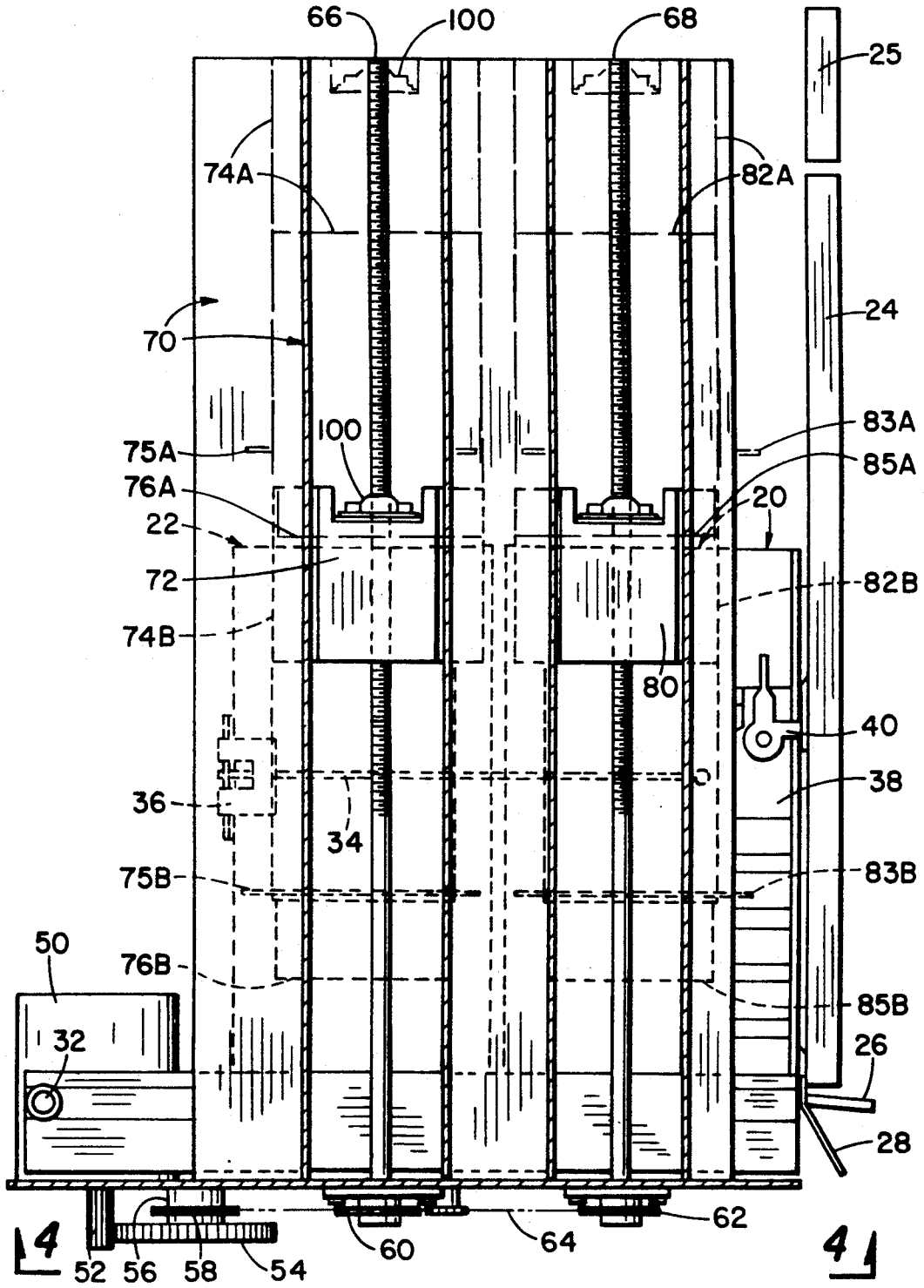
FIG. 3 is an elevational side view of the compactor drawer showing the compacting mechanism.
Figure 4:
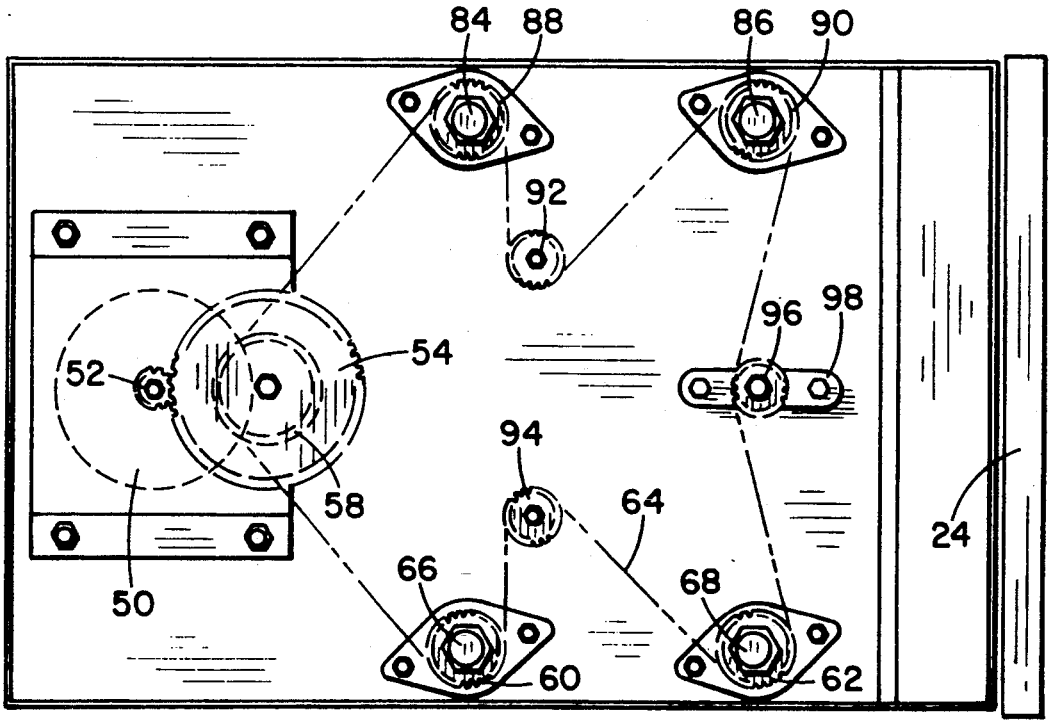
FIG. 4 is a bottom plan view of the compactor along line 3—3 in FIG. 3.

FIG. 3 is another side view of the compactor drawer with the compacting mechanism shown. This includes a motor 50 which turns a geared shaft 52 which then turns gear 54. The gear 54 is mounted on a shaft 56 which has a sprocket 58 mounted on it, such that when the gear 54 and shaft 56 turn, the sprocket 58 turns. Additional sprockets are present, and include a left rear compartment power screw sprocket 60 and a left front compartment power screw sprocket 62, and as shown in FIG. 4, similar sprockets are provided on the right-hand side. A drive chain 64 engages all of the sprockets. Extending upward from the base of the drawer is a left rear compactor power screw 66 and a left front compactor power screw 68. Surrounding the power screws 66 and 68 is a frame 70. Within the frame 70 there are two compacting rams 72 and 80. A rear compacting ram 72 is mounted on the rear power screws 66 and 84 and serves to compress trash (when in the "down" position) in the rear compartment (shown in dotted outline) 22. When the rear ram 72 is in the "up" position, the ram pad is shown in dotted outline as 74A; the ram wiper is shown as 75A; and the base of the rear ram cover, which covers the compacting head, is shown at dotted line 76A. The ram 72, when in the "up" or retracted position, clears the top of the compartment 22 to allow the drawer to slide open, i.e. the base of the ram shown at 75A, clears the top of the compartment 22. When the compacting ram 72 is in the "down" or compacting position, the ram pad is shown, in dotted outline, at 74B; the ram wiper (in partial dotted outline) at 75B; and the base of the rear ram cover is shown by dotted line at 76B. Thus the rear ram 72 moves up and down on the power screws 66 and 84 by threads within (not shown) to compress material in the rear compartment 22.

Still referring to FIG. 3, the front or forward compacting ram 80 moves up and down on screws 68 and 86 and serves to compress trash (when in the "down" position) in the rear compartment (shown partially in dotted outline) 20. When the front ram 80 is in the "up" position, the ram pad is shown in dotted outline as 82A; the front ram wiper is show at 83A; and the base of the front ram cover, which covers the front compacting head, is shown at dotted line 85A. The ram 80, when in the up position thus clears the top of the compartment 20 allowing the drawer to be slid open. When the front compacting ram 80 is in the "down" or compacting position, the ram pad is shown at 82B; the ram wiper (in dotted outline) at 83B; and the base of the front ram cover is shown in dotted outline at 85B. Thus, the from ram 80 moves up and down on the power screws 68 and 86 by threads within (not shown) to compress material in the front compartment 20.

In use, the motor 50 turns the shaft 52 which turns gear 54 which turns sprocket 58. The chain 64 then turns all of the sprockets 60, 62, 88 and 90 causing the respective compactor screws 66, 68, 84 and 86 to turn, which raises or lowers the rams 72 and 80, depending on which direction the screws are turning.

FIG. 3 also illustrates the drawer front 24 with a console escutcheon 25; foot pedal 26 and toe guard 28.

FIG. 4 is a bottom view of the compactor as viewed from section 4—4 in FIG. 3. This illustrates the motor 50, shaft 52 and gear 54. As shown, there are two power compactor screws serving each ram: the left rear screw 66 and the left front screw 68 were shown in FIG. 3, now the lower ends of the right rear screw 84 and of the right front screw 86 are also shown. Also illustrated in this view are the various sprockets: left rear sprocket 60, left front sprocket 62, right rear sprocket 88 and right front sprocket 90. Three additional sprockets 92, 94, and 96 are also shown; these keep tension on the chain 64 and provide greater chain to sprocket contact. Note that sprocket 96 is mounted on an adjustable bracket 98 which allows tension on the chain 64 to be varied.

Figure 5:
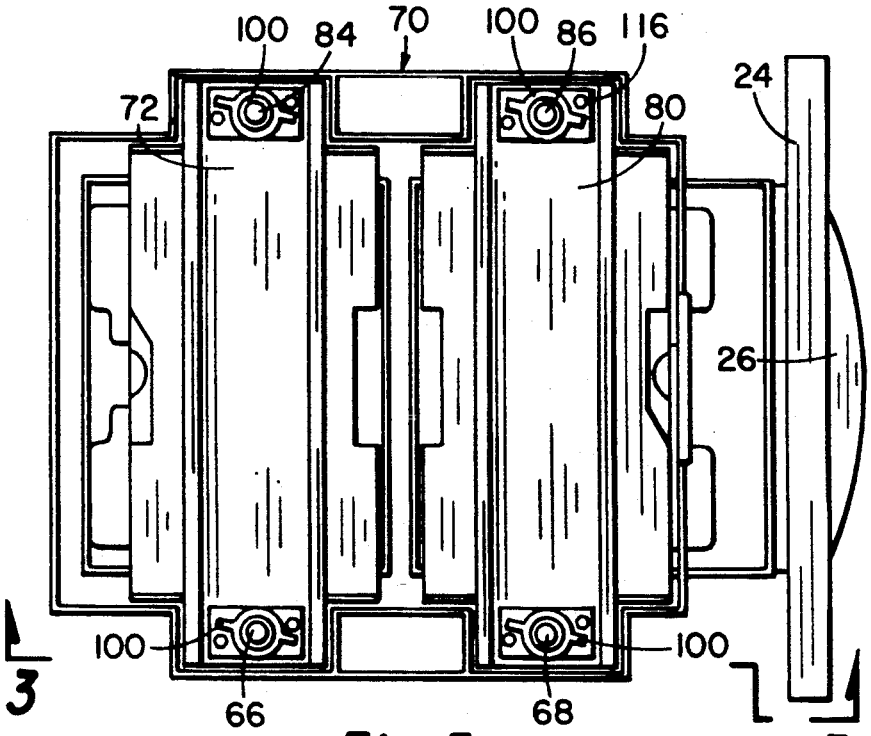
FIG. 5 is a top plan view of the compactor.

FIG. 5 is a top plan view of the compactor. This illustrates the front ram 80 and the rear ram 72. The ends of the four drive screws, 66, 68, 84, and 66 are shown. Each of these screws has a threaded nut 100 around it that is mounted on, and secured to, the sides of each ram 72 and 80. The housing 70 is also shown. As noted above, other types of commercially available compacting means, such as screw jacks, may be used.

Figure 6:
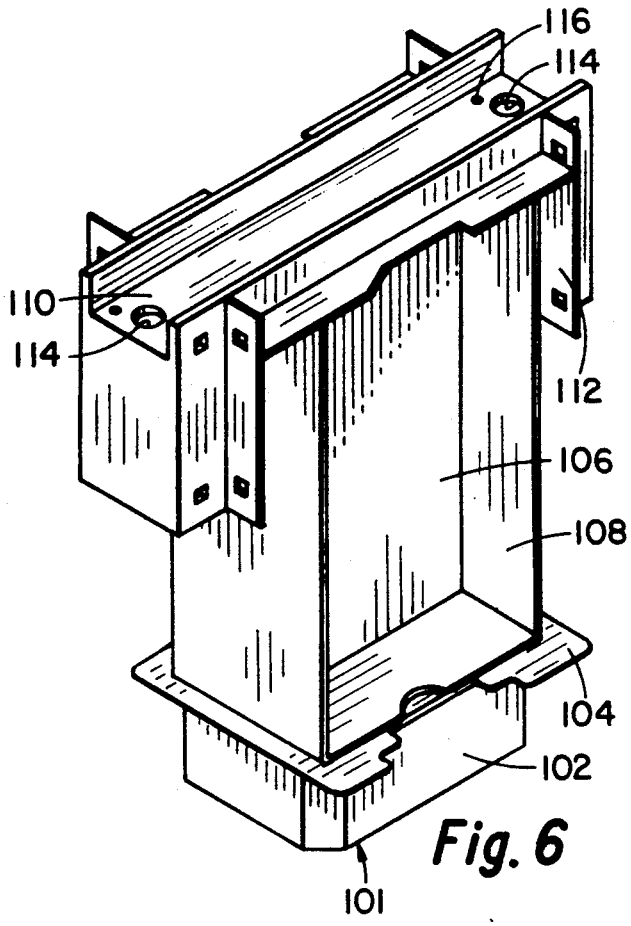
FIG. 6 is an isometric view of one of the rams.

FIG. 6 is an isometric view of one of the rams. The ram cover 102 surrounds the compacting head 101 which may be a flat piece of rigid material such as steel. Above this is a ram wiper 104 which fits snugly within the inside of each of the compartments 20 and 22. A ram bulkhead 106 and ram side panels 108 support and connect the compacting head 101 to the top frame 110. The top frame 110 has downward extending ram pads 112 which fit outside the compacting compartments 20 or 22. Holes 114 for the compacting drive screws 66, 68, 84, and 86 are provided in the top frame 110. Smaller holes 116 are placed beside holes 114 for the compacting screw to secure the nut and retainer 100 to the top of frame 110.

Figure 7:
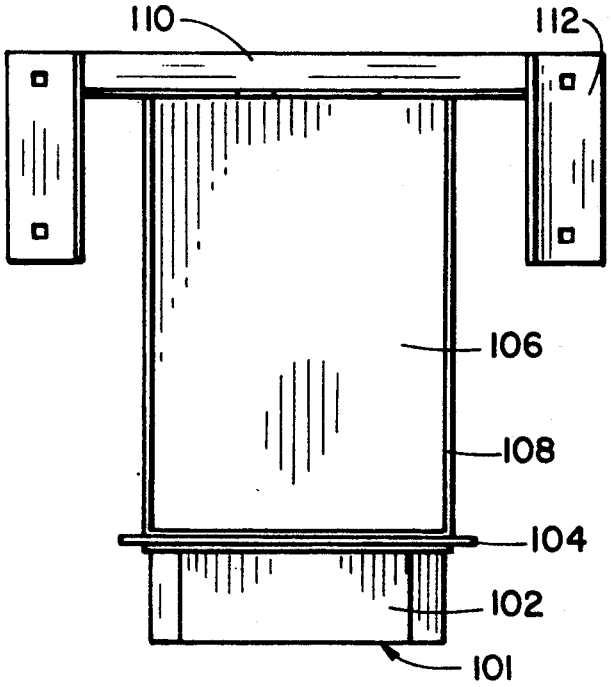
FIG. 7 is an elevational side view of one of the rams.

FIG. 7 is a side view of a ram. This shows how the bulkhead 106, ram wiper 104 and compacting head 101 are configured to fit within the compacting compartments, While the ram pads 112 are more widely spaced to fit without the compacting compartments.

Figure 9:
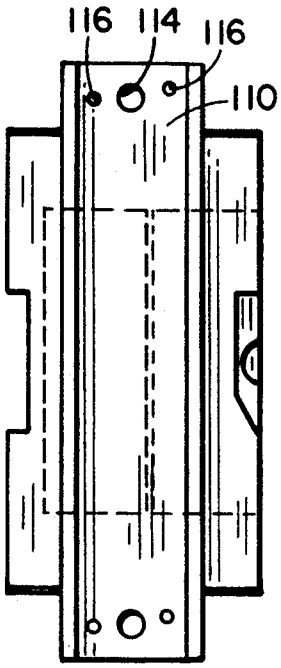
FIG. 9 is a plan top view of one of the rams.
Figure 8:
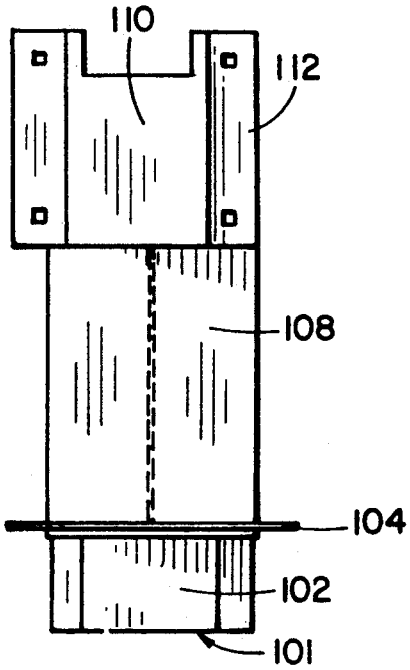
FIG. 8 is an elevational edge view of one of the rams.

FIG. 8 illustrates a ram in end view, and FIG. 9 illustrates a ram in plan top view. In operation, the drawer 24 is opened and trash placed in the compartments (recyclable trash in one compartment, and disposable trash in the other compartment). The drawer 24 is then closed and motor 50 is activated by a manual switch (not shown). The activated motor 50 turns shaft 52 which turns gear 54 which turns gear shaft 56 on which sprocket 58 is mounted and turns causing chain 64 to move, thus turning sprockets 60, 62, 88, 90, 92, 94, and 96. Sprockets 60, 62, 88 and 90 turn screws 66, 68, 84 and 86 respectively. Screws 68 and 86 extend upward through the front ram 80 and through the threaded nuts 100 attached to the top of the ram, while screws 66 and 84 extend upward through the rear ram 72 and the threaded nuts 100 attached thereto. Thus, when the screws 66, 68, 84 and 86 turn, they raise or lower the rams 72 and 80 in the compartments 20 and 22 of the drawer. When the rams 72 and 80 are moving downward (compacting) they will continue until the motor 50 is turned off or until the motor stalls or a preselected compression force is obtained, then the motor 50 reverses, raising the rams 72 and 80 to their full upright position, this may be accomplished by an automatic reversal switch (not shown) which is well known in the art.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A residential trash compactor comprising:

a housing defining a front portion and a rear portion;

a drawer slidable disposed within said housing and having tandemly positioned therein a front individual trash receiving compartment within said drawer and a rear individual trash receiving compartment within said drawer;

a first compacting ram configured to fit and vertically move within said front individual trash receiving compartment;

a second compacting ram configured to fit and vertically move within said rear individual trash receiving compartment;

a first pair of drive screws threadably engaged within said front compacting ram and having an upper end and a lower end;

a second pair of drive screws threadably engaged within said rear compacting ram and having an upper end and a lower end;

a first group of four sprockets attached to the lower ends of each of said first and second pairs of drive screws;

a single endless drive chain configured to movably engage each of said sprockets;

a second group of two sprockets placed centrally to said first group of four sprockets and engaging said drive chain so as to cause increased meshing of said drive chain with said first group of sprockets;

a third sprocket adjustably mounted toward the front of the drawer and engaging said drive chain so as to allow the tension on said chain to be varied; and a motor having means to engage the drive chain to rotate said drive screws.

* * * * *